US010330123B2

(12) United States Patent
Nakashima et al.

(10) Patent No.: US 10,330,123 B2
(45) Date of Patent: Jun. 25, 2019

(54) EJECTOR FOR REFRIGERATION CYCLE DEVICE

(71) Applicant: DENSO CORPORATION, Kariya, Aichi-pref. (JP)

(72) Inventors: Ryota Nakashima, Kariya (JP); Etsuhisa Yamada, Kariya (JP); Haruyuki Nishijima, Kariya (JP); Yoshiaki Takano, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 372 days.

(21) Appl. No.: 14/908,598

(22) PCT Filed: Jul. 25, 2014

(86) PCT No.: PCT/JP2014/003931

§ 371 (c)(1),
(2) Date: Jan. 29, 2016

(87) PCT Pub. No.: WO2015/015783

PCT Pub. Date: Feb. 5, 2015

(65) Prior Publication Data

US 2016/0186782 A1 Jun. 30, 2016

(30) Foreign Application Priority Data

Aug. 1, 2013 (JP) ..... 2013-160100

(51) Int. Cl.
*F04F 5/04* (2006.01)
*F04F 5/44* (2006.01)
(Continued)

(52) U.S. Cl.
CPC ..... *F04F 5/04* (2013.01); *F04F 5/10* (2013.01); *F04F 5/44* (2013.01); *F04F 5/46* (2013.01);
(Continued)

(58) Field of Classification Search
CPC ..... F04F 5/48; F04F 5/50; F04F 5/52; F04F 5/20; F04F 5/02; F04F 5/42; F04F 5/24;
(Continued)

(56) References Cited

U.S. PATENT DOCUMENTS 1,027,321 A * 5/1912 Cleveland ..... F04F 5/52 417/187
1,067,653 A * 7/1913 Hearing ..... F04F 5/52 417/181
(Continued)

FOREIGN PATENT DOCUMENTS

JP S432670 B1 1/1968
JP S61076800 A 4/1986
(Continued)

OTHER PUBLICATIONS

International Search Report and Written Opinion (in Japanese with English Translation) for PCT/JP2014/003931, dated Sep. 30, 2014; ISA/JP.

*Primary Examiner* — Bryan M Lettman
(74) *Attorney, Agent, or Firm* — Harness, Dickey & Pierce, P.L.C.

(57) ABSTRACT

In an ejector, a substantially conical passage formation member is disposed in the interior of a body forming a space therein to define a nozzle passage functioning as a nozzle, a mixing passage in which an ejection refrigerant ejected from the nozzle passage and a suction refrigerant drawn from a suction passage are mixed together, and a diffuser passage that converts a kinetic energy of the refrigerant that has flowed out of the mixing passage into a pressure energy, between an inner peripheral surface of the body and the passage formation member. The passage formation member is configured so that a spread angle of a portion forming an outlet side of the nozzle passage is smaller than a spread angle of a portion forming an inlet side of the nozzle passage in a cross-section parallel to an axial direction of the passage formation member.

7 Claims, 5 Drawing Sheets

(51) Int. Cl.

| | |
|---|---|
| ***F04F 5/46*** | (2006.01) |
| ***F04F 5/48*** | (2006.01) |
| ***F04F 5/10*** | (2006.01) |
| ***F25B 1/00*** | (2006.01) |
| ***F25B 40/02*** | (2006.01) |

(52) U.S. Cl.
CPC ..... *F04F 5/48* (2013.01); *F25B 1/00* (2013.01); *F25B 40/02* (2013.01); *F25B 2341/001* (2013.01)

(58) Field of Classification Search
CPC ..... F04F 5/10; F04F 5/04; F04F 5/14; F04F 5/16; F04F 5/18; F04F 5/44; F04F 5/46; F04F 5/461; F04F 5/54
See application file for complete search history.

(56) References Cited

U.S. PATENT DOCUMENTS

| | | | | | |
|---|---|---|---|---|---|
| 2,987,007 | A * | 6/1961 | Conkling | F04F 5/461 | 417/189 |
| 3,829,027 | A * | 8/1974 | Mocarski | F04F 5/461 | 239/410 |
| 3,923,247 | A * | 12/1975 | White | F04F 5/46 | 239/14.2 |
| 6,364,625 | B1 * | 4/2002 | Sertier | F02M 37/025 | 417/151 |
| 7,207,190 | B2 * | 4/2007 | Sugiura | B41J 2/17596 | 62/500 |
| 2002/0000095 | A1 | 1/2002 | Takeuchi et al. | | |
| 2004/0172966 | A1 * | 9/2004 | Ozaki | F04F 5/04 | 62/500 |
| 2009/0232665 | A1 | 9/2009 | Gocho et al. | | |
| 2015/0033790 | A1 | 2/2015 | Yamada et al. | | |

FOREIGN PATENT DOCUMENTS

| | | | |
|---|---|---|---|
| JP | H01250000 | A | 10/1989 |
| JP | 2001200800 | A | 7/2001 |
| JP | 3331604 | B2 | 10/2002 |
| JP | 2003014318 | A | 1/2003 |
| JP | 2008202812 | A | 9/2008 |
| JP | 2008232458 | A | 10/2008 |
| JP | 2009133624 | A | 6/2009 |
| JP | 2010116927 | A | 5/2010 |
| JP | 2013177879 | A | 9/2013 |

* cited by examiner

EJECTOR FOR REFRIGERATION CYCLE DEVICE

CROSS REFERENCE TO RELATED APPLICATIONS

This application is a U.S. National Phase Application under 35 U.S.C. 371 of International Application No. PCT/JP2014/003931 filed on Jul. 25, 2014 and published in Japanese as WO 2015/015783 A1 on Feb. 5, 2015. This application is based on and claims the benefit of priority from Japanese Patent Application No. 2013-160100 filed on Aug. 1, 2013. The entire disclosures of all of the above applications are incorporated herein by reference.

TECHNICAL FIELD

The present disclosure relates to an ejector that depressurizes a fluid, and draws the fluid due to a suction action of an ejection fluid ejected at high speed.

BACKGROUND ART

Up to now, an ejector has been known as a depressurizing device that is applied to a vapor compression refrigeration cycle device. The ejector of this type has a nozzle portion that depressurizes a refrigerant, draws a gas-phase refrigerant which has flowed out of an evaporator due to a suction action of the ejection refrigerant ejected from the nozzle portion, mixes the ejection refrigerant with the suction refrigerant in a pressure increase part (diffuser portion), thereby being capable of increasing the pressure.

Accordingly, in a refrigeration cycle device (hereinafter, referred to as an ejector refrigeration cycle) including the ejector as the depressurizing device, a power consumption of a compressor can be decreased by the aid of a refrigerant boost action in the pressure increase part of the ejector, and a coefficient of performance (COP) of a cycle can be improved to a greater extent than a general refrigeration cycle device including an expansion valve or the like as a depressurizing device.

Further, Patent Document 1 discloses an ejector having a nozzle portion which depressurizes the refrigerant in two stages as the ejector that is applied to the ejector refrigeration cycle. In more detail, in the ejector of Patent Document 1, the refrigerant of a high pressure liquid-phase state is depressurized into a gas-liquid two-phase state in a first nozzle, and the refrigerant that has been put into the gas-liquid two-phase state is allowed to flow into a second nozzle.

With the above configuration, in the ejector of Patent Document 1, boiling of the refrigerant in the second nozzle is promoted to improve a nozzle efficiency as the overall nozzle portion, and the COP is to be further improved as the overall ejector refrigeration cycle.

In a general ejector, a diffuser portion (pressure increase part) is coaxially disposed on an extension line in an axial direction of a nozzle portion. In addition, Patent Document 2 discloses that a spread angle of the diffuser portion thus arranged is relatively reduced to enable an improvement in the ejector efficiency.

The nozzle efficiency means an energy conversion efficiency when a pressure energy of the refrigerant is converted into a kinetic energy in the nozzle portion. The ejector efficiency means an energy conversion efficiency as the overall ejector.

However, in the ejector of Patent Document 1, for example, a heat load of the ejector refrigeration cycle becomes low, and a pressure difference (a difference between a high pressure and a low pressure) between the pressure of a high-pressure side refrigerant and the pressure of a low-pressure side refrigerant in the cycle is reduced. As a result, the refrigerant is depressurized by the difference between the high pressure and the low pressure by the first nozzle, and most of the refrigerant may not be depressurized in the second nozzle.

In this case, an improvement in the nozzle efficiency by causing the gas-liquid two phase refrigerant to flow into the second nozzle is not obtained. As a result, the refrigerant may not be sufficiently pressurized by the diffuser portion.

On the contrary, it is conceivable that with the application of the diffuser portion having the relatively small spread angle disclosed in Patent Document 2 to the ejector of Patent Document 1 to improve the ejector efficiency, the refrigerant is sufficiently pressurized in the diffuser portion even in the low load of the ejector refrigeration cycle.

However, when the diffuser portion of this type is applied, a length of the nozzle portion in the axial direction becomes longer as the entire ejector. As a result, a volume of the ejector becomes unnecessarily longer in the normal load of the ejector refrigeration cycle.

PRIOR ART DOCUMENT

Patent Document

Patent Document 1: JP 3331604
Patent Document 2: JP 2003-14318 A

SUMMARY OF THE INVENTION

In view of the above, it is an objective of the present disclosure to limit a reduction in ejector efficiency without an increase in a volume in an ejector in which a refrigerant passage is defined on an outer peripheral side of a passage formation member.

According to an aspect of the present disclosure, an ejector is used for a vapor compression refrigeration cycle device. The ejector includes a body including a refrigerant inlet port through which a refrigerant is introduced, a swirling space in which the refrigerant flowing from the refrigerant inlet port is swirled, a depressurizing space in which the refrigerant flowing out of the swirling space is depressurized, a suction passage that communicates with a downstream side of the depressurizing space in a refrigerant flow and draws a refrigerant from an external, and a pressurizing space into which an ejection refrigerant ejected from the depressurizing space and a suction refrigerant drawn through the suction passage flow. The ejector further includes a passage formation member that is disposed at least in an interior of the depressurizing space and in an interior of the pressurizing space and has a conical shape increasing in cross-sectional area with distance from the depressurizing space. The depressurizing space has a nozzle passage, which functions as a nozzle that depressurizes and ejects the refrigerant that has flowed out of the swirling space, between an inner peripheral surface of the body and an outer peripheral surface of the passage formation member. The pressurizing space has a diffuser passage, which functions as a diffuser that converts a kinetic energy of a mixed refrigerant of the ejection refrigerant and the suction refrigerant into a pressure energy, between the inner peripheral surface of the body and the outer peripheral surface of the passage formation member. In a cross-section parallel to an axial direction of the passage formation member, the outer peripheral surface of the passage formation member that defines the nozzle passage has a curved surface, and an increasing rate of a distance from a center axis of the passage formation member to the curved surface gradually reduces toward the downstream side in the refrigerant flow. The passage formation member has a contact portion that contacts the body in the nozzle passage when the passage formation member is displaced in the axial direction, in the cross-section parallel to the axial direction of the passage formation member. In the cross-section parallel to the axial direction, an acute angle between a tangent at the contact portion and the center axis is defined as θ2. The passage formation member has a nozzle outlet portion that defines an outlet of the nozzle passage in the cross-section parallel to the axial direction. In the cross-section parallel to the axial direction, an acute angle between a tangent at the nozzle outlet portion and the center axis is defined as θ3. The angle θ2 and the angle θ3 satisfy a condition: $\theta 2 \geq \theta 3$.

According to the above configuration, since the angle θ2 is equal to or larger than the angle θ3 in a cross-section parallel to the axial direction of the passage formation member, a spread angle of a portion of the passage formation member in which an outlet side of the nozzle passage is provided can be reduced more than a spread angle of the portion of the passage formation member in which an inlet side of the nozzle passage is provided.

In other words, the spread angle of the portion in which the outlet side of the nozzle passage is provided can be set to a relatively small value regardless of the spread angle of the portion of the passage formation member in which the inlet side of the nozzle passage is provided, and a flowing direction of a mainstream of the ejection refrigerant ejected from the nozzle passage can be brought closer to the axial direction of the passage formation member.

Further, the flowing direction of the mainstream of the suction refrigerant flowing out of the suction passage and joining the ejection refrigerant is brought closer to the axial direction with the result that an intersecting angle between the flowing direction of the mainstream of the ejection refrigerant and the flowing direction of the mainstream of the suction refrigerant can be reduced. Therefore, an energy loss (mixing loss) when the ejection refrigerant joins the suction refrigerant can be suppressed, and a reduction in the ejector efficiency can be suppressed.

In this situation, even with the provision of a guide member for bringing the flowing direction of the mainstream of the suction refrigerant flowing out of the suction passage and joining the ejection refrigerant closer to the axial direction, there is no need to form the guide member into a shape that spreads in the radial direction. Therefore, the volume of the passage formation member in the radial direction can be restrained from being increased as the overall ejector.

Further, even if the spread angle of the portion of the passage formation member in which the outlet side of the nozzle passage is provided is set to the relatively small value in the cross-section parallel to the axial direction of the passage formation member, the spread angle of the portion in which the inlet side of the nozzle passage is provided can be set to an appropriate value.

Therefore, in the configuration in which the passage formation member is displaced to change the refrigerant passage cross-sectional area of the nozzle passage, the degree of change in the refrigerant passage cross-sectional area on the inlet side of the nozzle passage relative to the amount of displacement (the amount of stroke) of the passage formation member can be restrained from being reduced.

With the above configuration, there is no need to increase the maximum amount of displacement of the passage formation member for the purpose of properly adjusting the refrigerant passage cross-sectional area on the inlet side of the nozzle passage, and the volume of the passage formation member in the axial direction can be restrained from being increased as the overall ejector.

In other words, in the ejector in which the refrigerant passage is defined on the outer peripheral side of the passage formation member, the flowing direction of the mainstream of the ejection refrigerant can be brought closer to the flowing direction of the mainstream of the suction refrigerant without increasing the volume. Therefore, a reduction in the ejector efficiency can be suppressed with the suppression of the energy loss when the ejection refrigerant joins the suction refrigerant.

The passage formation member is not strictly limited to one having only the shape in which the cross-sectional area increases with distance from the depressurizing space as described above. At least a part of the passage formation member may include a shape in which the cross-sectional area increases with distance from the depressurizing space whereby the diffuser passage can be shaped to spread outward with distance from the depressurizing space.

Further, "formed into a conical shape" is not limited to a meaning that the passage formation member is formed into a complete conical shape. In other words, "formed into a conical shape" is not limited to a shape in which the cross-sectional shape parallel to the axial direction is an isosceles triangle, but means the inclusion of a shape in which two sides having an apex interposed therebetween are convex toward an inner peripheral side, a shape in which the two sides having the apex interposed therebetween are convex toward an outer peripheral side, a shape whose cross-sectional shape is semicircular, and shapes in which those shapes are combined together.

EMBODIMENTS FOR EXPLOITATION OF THE INVENTION

Figure 1:
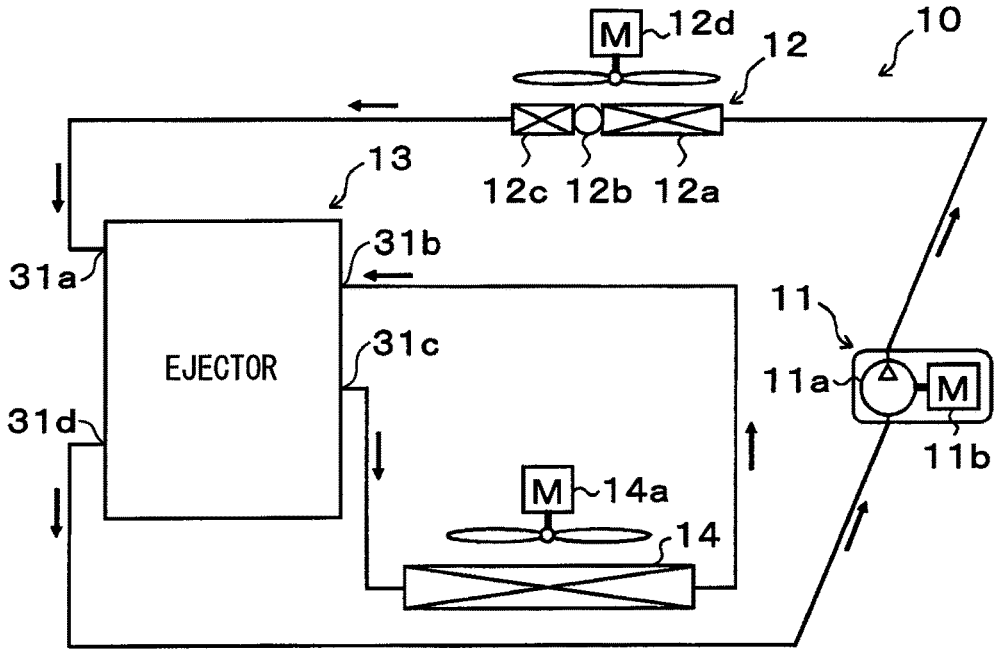
FIG. 1 is a schematic diagram of an ejector refrigeration cycle according to an embodiment of the present disclosure.

The present inventors have proposed an ejector applied to an ejector refrigeration cycle in Japanese Patent Application No. 2012-184950 (hereinafter referred to as "earlier application example") in advance. The ejector includes a body having a swirling space in which a refrigerant that has flowed out of a radiator is swirled, a depressurizing space in which the refrigerant that has flowed out of the swirling space is depressurized, a suction passage that communicates with a downstream side of the depressurizing space in a refrigerant flow, into which the refrigerant that has flowed out of an evaporator is drawn, and a pressurizing space in which the ejection refrigerant ejected from the depressurizing space and the suction refrigerant drawn from the suction passage are mixed together and pressurized. The ejector further includes a passage formation member disposed at least inside of the depressurizing space, and inside of the pressurizing space, and having a conical shape that increases in cross-sectional area with distance from the depressurizing space. The depressurizing space has a nozzle passage between the inner peripheral surface of the body and the outer peripheral surface of the passage formation member. The nozzle passage functions as a nozzle that depressurizes the refrigerant that has flowed out of the swirling space, and ejects the refrigerant. The pressurizing space has a diffuser passage between the inner peripheral surface of the body and the outer peripheral surface of the passage formation member. The diffuser passage functions as a diffuser that pressurizes a mixed refrigerant of the ejection refrigerant and the suction refrigerant. Further, the ejector includes a drive device that changes a refrigerant passage cross-sectional area of the nozzle passage with the displacement of the passage formation member.

In the ejector of the earlier application example, the refrigerant is swirled in the swirling space with the results that a refrigerant pressure on a swirling center side within the swirling space can be reduced to a pressure of a saturated liquid-phase refrigerant, or a pressure at which the refrigerant is depressurized and boiled (cavitation occurs). With the above operation, a larger amount of gas-phase refrigerant is present on an inner peripheral side than an outer peripheral side of a swirling center axis. This leads to a two-phase separation state in which the refrigerant has a gas single phase in the vicinity of a swirling center line within the swirling space, and has a liquid single phase around the vicinity thereof.

The refrigerant of the two-phase separation state flows into the nozzle passage, and boiling of the refrigerant is promoted by wall surface boiling and interface boiling. Therefore, the refrigerant puts into a gas-liquid mixed state in which a gas phase and a liquid phase are homogeneously mixed together in the vicinity of a minimum flow channel area portion of the nozzle passage. The refrigerant in a gas-liquid mixed state is sealed (choked) in the vicinity of the minimum flow channel area portion of the nozzle passage, and a flow velocity of the refrigerant in the gas-liquid mixed state is accelerated until the flow rate becomes a two-phase sonic speed.

The refrigerant thus accelerated to the two-phase sonic speed becomes an ideal two-phase spray flow in which the two phases are homogeneously mixed together on a downstream side of the minimum flow channel area portion in the nozzle passage, and the flow rate can be further increased. As a result, the energy conversion efficiency (corresponding to the nozzle efficiency) in converting a pressure energy of the refrigerant into a kinetic energy in the nozzle passage can be improved.

In the ejector of the earlier application example, the passage formation member is formed into a conical shape, and the shape of the diffuser passage is enlarged along the outer periphery of the passage formation member with distance from the depressurizing space. Accordingly, an increase of dimensions of the diffuser passage in the axial direction is suppressed, and an increase in the volume of the entire ejector can be suppressed.

Further, in the ejector of the earlier application example, since the drive device is provided, the refrigerant passage cross-sectional area of the nozzle passage can be adjusted according to a load variation of the ejector refrigeration cycle. Therefore, according to the ejector of the earlier application example, even when a variation in the load of the ejector refrigeration cycle occurs, a decrease in the energy conversion efficiency (corresponding to the nozzle efficiency) in the nozzle passage can be suppressed without increasing a volume.

Meanwhile, in order to further improve the energy conversion efficiency of the ejector, the inventors have reviewed the ejector of the earlier application example. As a result, in the ejector of the earlier application example, a reduction in the energy conversion efficiency in the nozzle passage can be suppressed. However, the energy conversion efficiency (ejector efficiency) as the overall ejector may be lower than a desired value.

Therefore, the present inventors have investigated the causes of the above drawback, and found that in the ejector of the earlier application example, because the refrigerant passage is defined on the outer peripheral side of the passage formation member formed into the conical shape, the flowing direction of the mainstream of the ejection refrigerant ejected from the nozzle passage intersects with the flowing direction of the mainstream of the suction refrigerant joining the ejection refrigerant at a relatively large angle (specifically, 60° or larger) in a cross-section parallel to the axial direction of the passage formation member.

The reason is because when the flowing direction of the mainstream of the ejection refrigerant intersects with the flowing direction of the mainstream of the ejection refrigerant at the relatively large angle, the energy loss (mixing loss) when the ejection refrigerant joins the suction refrigerant increases, and the kinetic energy of the mixture refrigerant to be converted into the pressure energy is reduced in the diffuser passage.

In order to reduce the above mixture loss, it is effective to reduce an intersection angle between the flowing direction of the mainstream of the ejection refrigerant and the flowing direction of the mainstream of the suction refrigerant. Specifically, since the ejection refrigerant flows along the outer peripheral side surface of the passage formation member in the cross-section parallel to the axial direction of the passage formation member, a guide member (guide member) for guiding the suction refrigerant joining the ejection refrigerant to flow along the outer peripheral side surface of the passage formation member may be added.

However, the guide member thus configured is formed into a shape spread toward the outer peripheral side along the outer peripheral side surface of the passage formation member, and disposed between the outlet side of the nozzle passage and an outlet side of the suction passage. Therefore, the guide member may cause the volume of the passage formation member to be increased in the radial direction as the overall ejector. Further, when the multiple components are combined together into the body as in the ejector of the earlier application example, the addition of the guide member may cause the assembly of the body to be deteriorated.

In order to reduce the mixing loss described above without increasing the volume of the ejector in the radial direction, with a reduction in the spread angle of the passage formation member in the cross-section parallel to the axial direction of the passage formation member, both of the flowing direction of the mainstream of the ejection refrigerant and the flowing direction of the mainstream of the suction refrigerant may be brought closer to the axial direction of the passage formation member.

However, in the ejector of the earlier application example, since the refrigerant in the two-phase separation state on the swirling center side in the swirling space is allowed to flow into the nozzle passage to improve the energy conversion efficiency in the nozzle passage, the nozzle passage must be defined on the outer peripheral side of an apex (tip part) of the passage formation member.

For that reason, when the spread angle of the passage formation member is reduced, the degree of a change in the refrigerant passage cross-sectional area of the nozzle passage to the amount of displacement (the amount of stroke) of the passage formation member when the drive device displaces the passage formation member is reduced, and a maximum amount of displacement of the passage formation member required to appropriately adjust the refrigerant passage cross-sectional area of the nozzle passage increases. This leads to a risk that the volume of the passage formation member in the axial direction is increased as the overall ejector.

An embodiment of the present disclosure will be described with reference to FIGS. 1 to 5. As illustrated in FIG. 1, an ejector 13 of this embodiment is applied to a vapor compression refrigeration cycle device including an ejector as a refrigerant depressurizing device, that is, an ejector refrigeration cycle 10. Moreover, the ejector refrigeration cycle 10 is applied to a vehicle air conditioning apparatus, and performs a function of cooling blast air which is blown into a vehicle interior that is a space to be air-conditioned.

The ejector refrigeration cycle 10 employs an HFC based refrigerant (specifically, R134a) as the refrigerant, and configures a subcritical refrigeration cycle in which a high pressure-side refrigerant pressure does not exceed a critical pressure of the refrigerant. The refrigeration cycle device 10 may employ an HFO based refrigerant (specifically, R1234yf) or the like as the refrigerant. Furthermore, refrigerator oil for lubricating the compressor 11 is mixed in the refrigerant, and a part of the refrigerator oil circulates in the cycle together with the refrigerant.

In the ejector refrigeration cycle 10, the compressor 11 draws the refrigerant, pressurizes the refrigerant until the refrigerant becomes a high-pressure refrigerant, and discharges the pressurized refrigerant. Specifically, the compressor 11 of this embodiment is an electric compressor that is configured to accommodate a fixed capacity type compression mechanism 11*a* and an electric motor 11*b* for driving the compression mechanism 11*a* in a single housing.

As the compression mechanism 11*a*, various compression mechanisms such as a scroll compression mechanism or a vane compression mechanism can be employed. The operation (rotation speed) of the electric motor 11*b* is controlled according to a control signal output from a control device to be described below, and the electric motor 11*b* may be configured by any type of an AC motor and a DC motor.

The compressor 11 may be configured by an engine driven compressor that is driven by a rotation driving force transmitted from a vehicle travel engine through a pulley, a belt, or the like. As the engine driven compressor of this type, a variable capacity type compressor that can adjust a refrigerant discharge capacity by a change in discharge capacity, or a fixed capacity type compressor that adjusts the refrigerant discharging capacity by changing an operation rate of the compressor through connection/disconnection of an electromagnetic clutch can be applied.

A refrigerant inlet side of a condenser 12*a* of a heat radiator 12 is connected to a discharge port of the compressor 11. The radiator 12 is a radiation heat exchanger which performs heat exchange between a high-pressure refrigerant discharged from the compressor 11 and a vehicle exterior air (outside air) blown by a cooling fan 12*d* to radiate the heat of the high-pressure refrigerant for cooling.

More specifically, the heat radiator 12 is a so-called subcooling condenser including: the condenser 12*a*, a receiver part 12*b*, and a subcooling portion 12*c*. The condenser 12*a* performs heat exchange between the high pressure gas-phase refrigerant discharged from the compressor 11 and the outside air blown from the cooling fan 12*d*, and radiates the heat of the high pressure gas-phase refrigerant to condense the refrigerant. The receiver part 12*b* separates gas and liquid of the refrigerant that has flowed out of the condenser 12*a* and stores a surplus liquid-phase refrigerant. The subcooling portion 12*c* performs heat exchange between the liquid-phase refrigerant that has flowed out of the receiver part 12*b* and the outside air blown from the cooling fan 12*d* to subcool the liquid-phase refrigerant.

The cooling fan 12*d* is an electric blower of which the rotation speed (the amount of blast air) is controlled by a control voltage output from the control device. A refrigerant inlet port 31*a* of the ejector 13 is connected to a refrigerant outlet side of the subcooling portion 12*c* of the heat radiator 12.

The ejector 13 functions as a refrigerant depressurizing device for depressurizing the high pressure liquid-phase refrigerant of the subcooling state, which has flowed out of the heat radiator 12, and allowing the refrigerant to flow out to the downstream side. The ejector 13 also functions as a refrigerant circulating device (refrigerant transport device) for drawing (transporting) the refrigerant that has flowed out of an evaporator 14 to be described later by the suction action of a refrigerant flow ejected at high speed to circulate the refrigerant. Further, the ejector 13 of this embodiment functions as a gas-liquid separation device for separating the depressurized refrigerant into gas and liquid.

Figure 3:
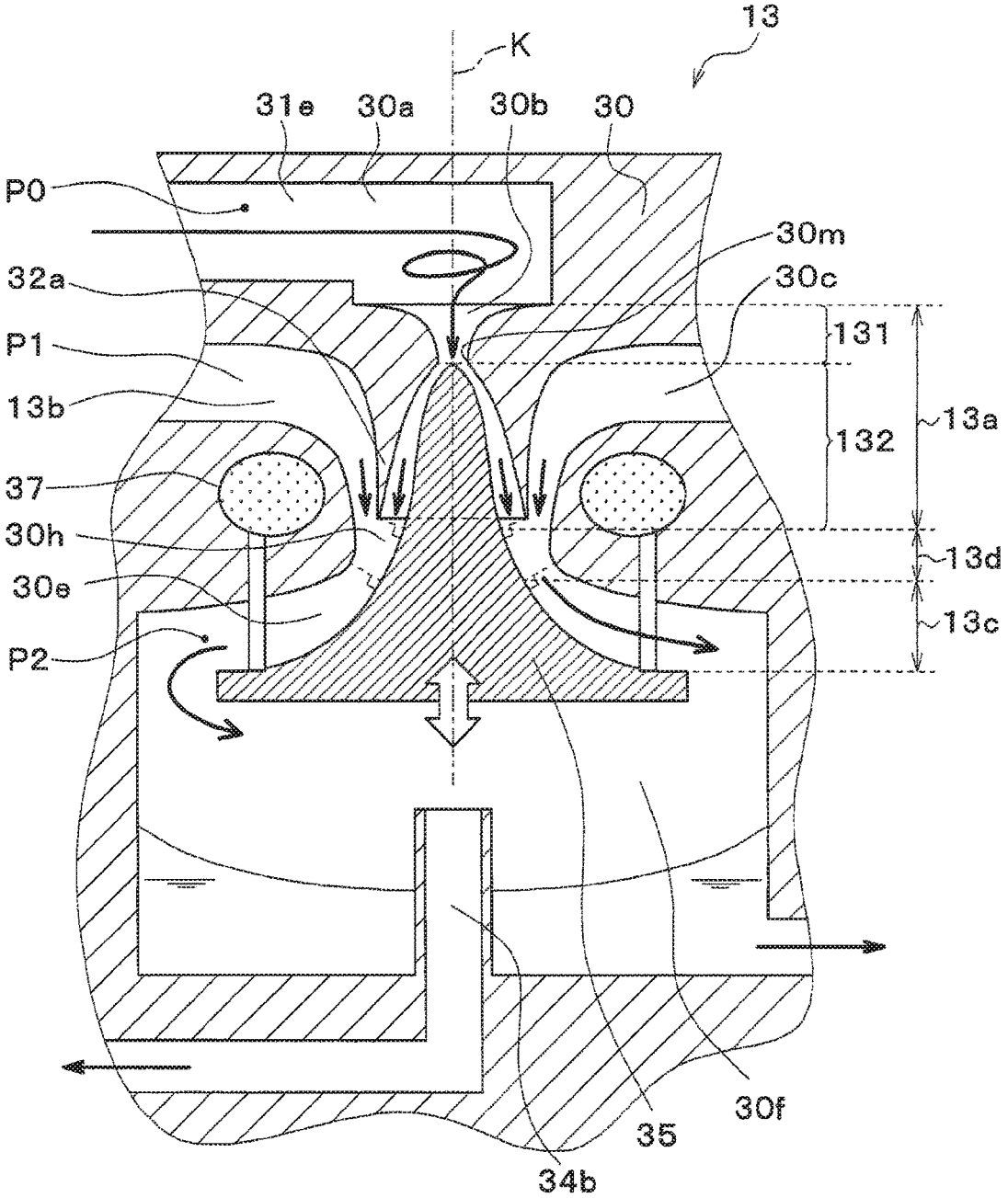
FIG. 3 is a schematic sectional diagram illustrating a function of each refrigerant passage in the ejector according to the embodiment.
Figure 4:
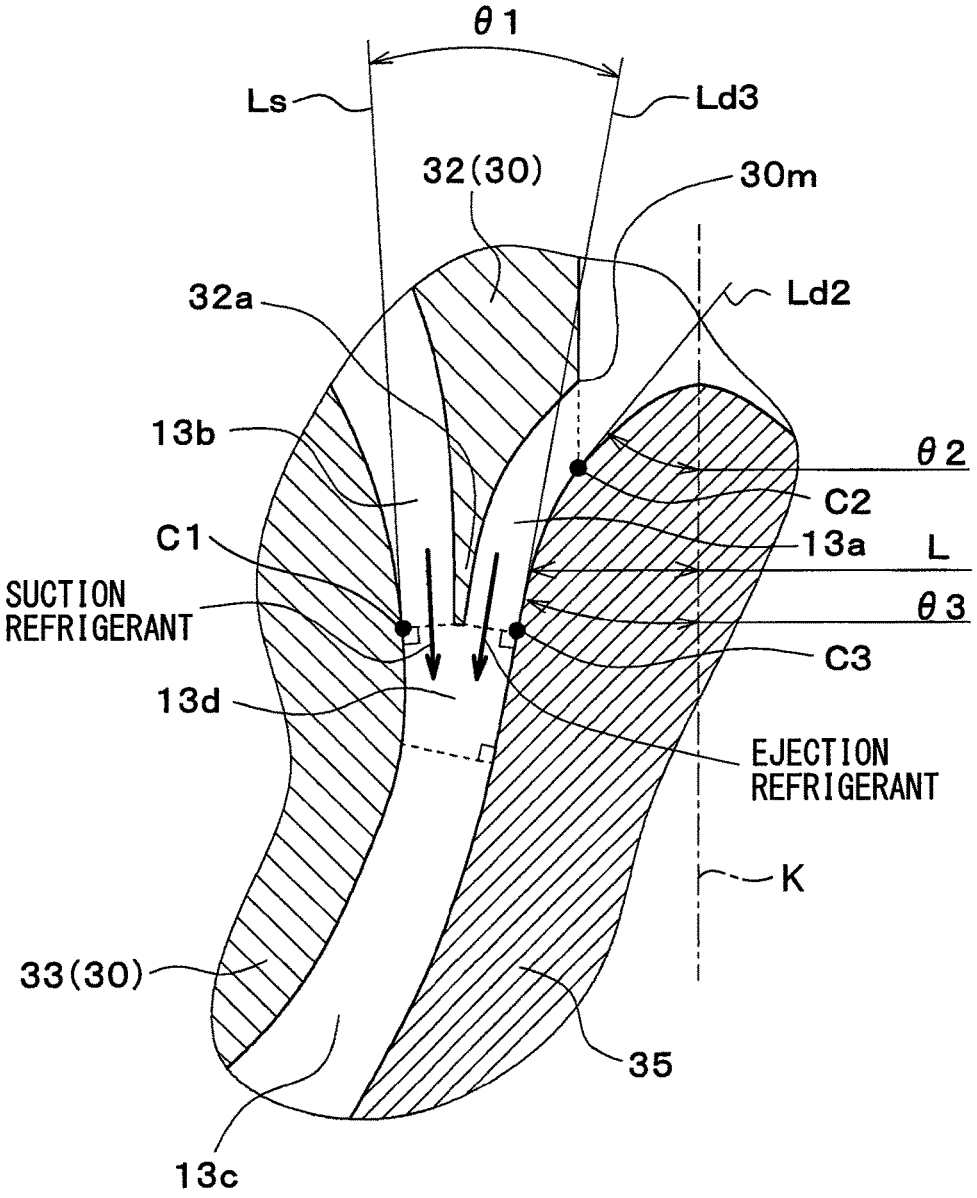
FIG. 4 is a schematic sectional view of a part IV in FIG. 2.

A specific configuration of the ejector 13 will be described with reference to FIGS. 2 to 4. Meanwhile, up and down arrows in FIG. 2 indicate, respectively, up and down directions in a state where the ejector refrigeration cycle 10 is mounted on a vehicle air conditioning apparatus. FIGS. 3 and 4 are schematic cross-sectional views illustrating the functions of the respective refrigerant passages of the ejector 13, and the same parts as those in FIG. 2 are denoted by identical symbols.

Figure 2:
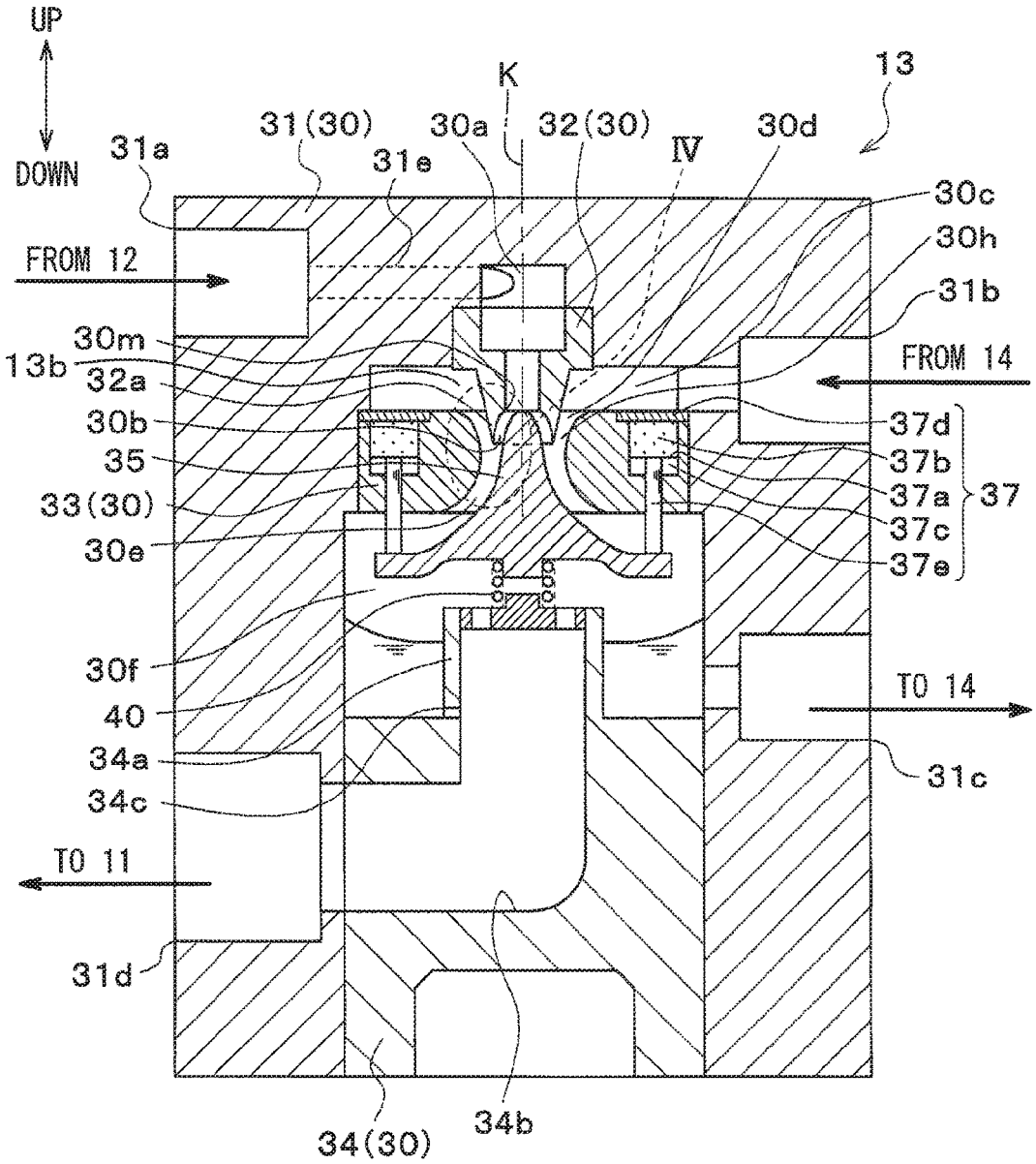
FIG. 2 is a sectional view illustrating the ejector according to the embodiment, taken along a line parallel to an axial direction of the ejector.

First, as illustrated in FIG. 2, the ejector 13 of this embodiment includes a body 30 configured by the combination of multiple components. Specifically, the body 30 has a housing body 31 made of prismatic-cylindrical or circular-cylindrical metal or resin, and forming an outer shell of the ejector 13. A nozzle body 32, a middle body 33, and a lower body 34 are fixed to an interior of the housing body 31.

The housing body 31 is formed with a refrigerant inlet port 31*a* through which the refrigerant that has flowed out of the heat radiator 12 flows into the housing body 31, and a refrigerant suction port 31*b* through which the refrigerant that has flowed out of the evaporator 14 is drawn into the housing body 31. The housing body 31 is also formed with a liquid-phase refrigerant outlet 31*c* through which a liquid-phase refrigerant separated by a gas-liquid separation space 30*f* formed within the body 30 flows out to the refrigerant inlet side of the evaporator 14, and a gas-phase refrigerant outlet port 31*d* through which the gas-phase refrigerant separated by the gas-liquid separation space 30*f* flows out to the intake side of the compressor 11.

The nozzle body 32 is formed of a substantially conically-shaped metal member that is tapered in a refrigerant flowing direction. The nozzle body 32 is fixed to the interior of the housing body 31 by a technique such as press fitting so that an axial direction of the nozzle body 32 is parallel to a vertical direction (up-down direction in FIG. 2). A swirling space 30*a* in which the refrigerant flowing from the refrigerant inlet port 31*a* is swirled is provided between an upper side of the nozzle body 32 and the housing body 31.

The swirling space 30*a* is formed into a rotating body shape, and a center axis K of the swirling space 30*a* indicated by an alternate long and short dash line in FIG. 2 extends in the vertical direction. Meanwhile, the rotating body shape is a solid shape formed by rotating a top view around one straight line (center axis) coplanar with the plane figure. More specifically, the swirling space 30*a* of this embodiment is formed into a substantially cylindrical shape. The swirling space 30*a* may be defined in a shape in which a circular cone or a circular truncated cone is combined with a cylinder, or the like.

Further, the refrigerant inlet passage 31*e* that connects the refrigerant inlet port 31*a* and the swirling space 30*a* extends in a tangential direction of an inner peripheral wall surface of a portion of the body 30 in which the swirling space 30*a* is defined when viewed in a center axis K direction of the swirling space 30*a*. Accordingly, the refrigerant that has flowed out of the refrigerant inlet passage 31*e* into the swirling space 30*a* flows along the inner peripheral wall surface of the portion of the body 30 in which the swirling space 30*a* is defined, and is swirled in the swirling space 30*a*.

Meanwhile, the refrigerant inlet passage 31*e* does not need to be defined to completely match the tangential direction of the swirling space 30*a* when viewed in the center axis K direction of the swirling space 30*a*. If the refrigerant inlet passage 31*e* includes at least a component in the tangential direction of the swirling space 30*a*, the refrigerant inlet passage 31*e* may be defined to include components in the other directions (for example, components in the axial direction of the swirling space 30*a*).

Since a centrifugal force acts on the refrigerant swirling in the swirling space 30*a*, a refrigerant pressure on the center axis K side becomes lower than a refrigerant pressure on the outer peripheral side in the swirling space 30*a*. Accordingly, in this embodiment, during an normal operation of the ejector refrigeration cycle 10, the refrigerant pressure on the center axis K side in the swirling space 30*a* is lowered to a pressure of a saturated liquid-phase refrigerant or a pressure at which a refrigerant is decompressed and boiled (cavitation occurs).

The adjustment of the refrigerant pressure on the center axis K side in the swirling space 30*a* can be realized by adjusting the swirling flow rate of the refrigerant swirling in the swirling space 30*a*. Further, the swirling flow rate can be adjusted by, for example, adjusting an area ratio between the passage cross-sectional area of the refrigerant inlet passage 31*e* and a cross-sectional area of the swirling space 30*a* perpendicular to the axial direction. Meanwhile, the swirling flow rate in this embodiment means the flow rate of the refrigerant in the swirling direction in the vicinity of an outermost peripheral part of the swirling space 30*a*.

A depressurizing space 30*b* that allows the refrigerant that has flowed out of the swirling space 30*a* to be depressurized, and flow out to the downstream side is defined within the nozzle body 32. The depressurizing space 30*b* is defined into a rotating body shape having a cylindrical space coupled with a circular truncated conical space that gradually expands in a refrigerant flowing direction continuously from a lower side of the cylindrical space. The depressurizing space 30*b* is disposed coaxially with the center axis K of the swirling space 30*a*.

Further, a passage formation member 35 is disposed in the interior of the depressurizing space 30*b*. The passage formation member 35 defines a minimum passage area part 30*m* smallest in the refrigerant passage cross-sectional area within the depressurizing space 30*b*, and changes the passage cross-sectional area of the minimum passage area part 30*m*. The passage formation member 35 is formed in an approximately conical shape which is gradually spread toward a downstream side of the refrigerant flow. The passage formation member 35 is disposed coaxially with the center axis K of the depressurizing space 30*b*. In other words, the passage formation member 35 is formed into a conical shape having a cross-sectional area increased with distance from the depressurizing space 30*b*.

The refrigerant passage is formed between an inner peripheral surface of a portion of the nozzle body 32 which defines the depressurizing space 30*b* and an outer peripheral surface of the upper side of the passage formation member 35. As illustrated in FIG. 3, the refrigerant passage includes a convergent part 131 and a divergent part 132. The convergent part 131 is formed on the upstream side of the minimum passage area part 30*m* in the refrigerant flow, in which the refrigerant passage cross-sectional area extending to the minimum passage area part 30*m* gradually decreases. The divergent part 132 is formed on the downstream side of the minimum passage area part 30*m* in the refrigerant flow, in which the refrigerant passage cross-sectional area gradually increases.

In the downstream side of the convergent part 131 and the divergent part 132, since the depressurizing space 30*b* overlaps with the passage formation member 35 when viewed from the radial direction, a cross-sectional shape of the refrigerant passage perpendicular to the axial direction is annular (doughnut shape obtained by removing a smaller-diameter circular shape arranged coaxially from the circular shape large in diameter).

Further, in this embodiment, the inner peripheral surface of the portion of the nozzle body 32 in which the depressurizing space 30*b* is defined and the outer peripheral surface of the passage formation member 35 are formed so that the refrigerant passage cross-sectional area of the divergent part 132 is gradually increased toward the downstream side of the refrigerant flow.

In this embodiment, the depressurizing space 30*b* has a nozzle passage 13*a* functioning as a nozzle between an inner peripheral surface of the nozzle body 32 and an outer peripheral surface of a top side of the passage formation member 35. Further, in the nozzle passage 13*a*, the refrigerant is depressurized, and ejected while a flow rate of the refrigerant in a gas-liquid two-phase state is accelerated to a value higher than a two-phase sonic speed.

In this embodiment, as illustrated in FIG. 3, the refrigerant passage provided between the inner peripheral surface of the depressurizing space 30*b* and the outer peripheral surface on the top side of the passage formation member 35 is a refrigerant passage defined in an area where a line segment extending from the outer peripheral surface of the passage formation member 35 in a normal direction crosses a portion of the nozzle body 32 in which the depressurizing space 30*b* is defined.

Since the refrigerant flowing into the nozzle passage 13*a* swirls in the swirling space 30*a*, the refrigerant flowing through the nozzle passage 13*a*, and the ejection refrigerant that is ejected from the nozzle passage 13*a* also have a velocity component in the same swirling direction as that of the refrigerant swirling in the swirling space 30*a*.

Next, as illustrated in FIG. 2, the middle body 33 is formed of a disc-shaped metal member that defines a through hole of the rotating body shape which penetrates through both sides thereof in the center of the middle body 33. The middle body 33 accommodates a driving device 37 on a radially outer side of the through hole, and the driving device 37 displaces the passage formation member 35 in the axial direction. Meanwhile, the through hole of the middle body 33 is disposed coaxially with the center axis K of the swirling space 30*a* and the depressurizing space 30*b*. The middle body 33 is fixed to the interior of the housing body 31 and the lower side of the nozzle body 32 by a technique such as press fitting.

Further, an inflow space 30*c* is defined between an upper surface of the middle body 33 and an inner wall surface of the housing body 31 facing the upper surface of the middle body 33, and the inflow space 30*c* accumulates the refrigerant that has flowed out of the refrigerant suction port 31*b*. In this embodiment, because a tapered tip part 32*a* of a lower side of the nozzle body 32 is located within the through hole of the middle body 33, the inflow space 30*c* is formed into an annular shape in cross-section when viewed in the center axis K direction of the swirling space 30*a* and the depressurizing space 30*b*.

A suction refrigerant inflow passage connecting the refrigerant suction port 31*b* and the inflow space 30*c* extends in a tangential direction of the inner peripheral wall surface of the inflow space 30*c* when viewed from the center axis K direction of the inflow space 30*c*. With the above configuration, in this embodiment, the refrigerant flowing into the inflow space 30*c* from the refrigerant suction port 31*b* through the suction refrigerant inflow passage is swirled in the same direction as that of the refrigerant in the swirling space 30*a*.

In an area in which the lower side of the nozzle body 32 is inserted into the through hole of the middle body 33, that is, in an area in which the middle body 33 and the nozzle body 32 overlap each other when viewed from a radial direction perpendicular to an axis line, the refrigerant passage cross-sectional area is gradually reduced toward the refrigerant flowing direction so as to match the outer peripheral shape of the tapered tip part 32*a* of the nozzle body 32.

Accordingly, a suction passage 30*d* is defined between the inner peripheral surface of the through hole and the outer peripheral surface of the tapered tip part 32*a* on the lower side of the nozzle body 32. The suction passage 30*d* communicates the inflow space 30*c* with the downstream side of the depressurizing space 30*b* in the refrigerant flow. In other words, in this embodiment, a suction passage 13*b* draws a refrigerant from the external, and is defined by the suction refrigerant inflow passage which connects the refrigerant suction port 31*b* and the inflow space 30*c*, the inflow space 30*c*, and the suction passage 30*d*.

A cross-section perpendicular to the center axis K of the suction passage 30*d* is also formed into an annular shape, and a refrigerant flowing through the suction passage 30*d* also has a velocity component of the refrigerant swirling in the same swirling direction as that of the refrigerant swirling in the swirling space 30*a*. A refrigerant outlet (specifically, a refrigerant outlet of the suction passage 30*d*) of the suction passage 13*b* is annularly opened on an outer peripheral side of a refrigerant outlet (refrigerant ejection port) of the nozzle passage 13*a*.

A mixing space 30*h* formed into a substantially cylindrical or substantially circular truncated conical shape is formed in the through hole of the middle body 33 on the downstream side of the suction passage 30*d* in the refrigerant flow. The mixing space 30*h* is a space into which the ejection refrigerant ejected from the above-mentioned depressurizing space 30*b* (specifically, nozzle passage 13*a*) joins the suction refrigerant drawn from the suction passage 13*b* (specifically, suction passage 30*d*).

An intermediate portion of the above-mentioned passage formation member 35 in a vertical direction is disposed in the mixing space 30*h*, and as illustrated in FIGS. 3 and 4, the refrigerant passage defined between the inner peripheral surface of a portion of the through hole of the middle body 33 in which the mixing space 30*h* is defined, and the outer peripheral surface of the passage formation member 35 configures a mixing passage 13*d* that promotes the mixing of the ejection refrigerant and the suction refrigerant.

In this embodiment, as illustrated in FIG. 3, the refrigerant passage provided between the inner peripheral surface of the mixing space 30*h* and the outer peripheral surface of the passage formation member 35 is a refrigerant passage defined in an area where a line segment extending from the outer peripheral surface of the passage formation member 35 in the normal direction crosses a portion of the middle body 33 in which the mixing space 30*h* is defined.

The shapes of the nozzle passage 13*a*, the suction passage 13*b*, and the mixing passage 13*d* will be described with reference to FIG. 4. As illustrated in FIG. 4, in a cross-section parallel to the axial direction of the passage formation member 35, the outer peripheral surface of the passage formation member 35 which defines the nozzle passage 13*a* has a curved surface in which an increasing rate of a distance L from the center axis K is gradually reduced toward the downstream side in the refrigerant flow.

As illustrated in FIG. 4, in the cross-section parallel to the axial direction of the passage formation member 35, the passage formation member 35 has a contact portion C2 that contacts the nozzle body 32 in the nozzle passage 13*a* when the passage formation member 35 is displaced toward the upper side in the axial direction, that is, the swirling space 30*a*. In the cross-section parallel to the axial direction of the passage formation member 35, an angle defined between a tangent Ld2 at the contact portion C2 and the center axis K on a side where the passage formation member 35 is sandwiched at an acute angle between the tangent Ld2 at the contact portion C2 and the center axis K is defined as θ2. In other words, the acute angle between the tangent Ld2 at the contact portion C2 and the center axis K is defined as θ2. In addition, in the cross-section parallel to the axial direction of the passage formation member 35, the passage formation member 35 has a nozzle outlet portion C3 that defines an outlet of the nozzle passage 13*a*. The nozzle outlet portion C3 is disposed in a region corresponding to a displaceable area of the passage formation member 35 on the outer peripheral surface of the passage formation member 35. An angle defined between a tangent Ld3 at the nozzle outlet portion C3 and the center axis K at a side where the passage formation member 35 is sandwiched at an acute angle between the tangent Ld3 at the nozzle outlet portion C3 and the center axis K is defined as θ3. In other words, the acute angle between the tangent Ld3 at the nozzle outlet portion C3 and the center axis K is defined as θ3. The angles θ2 and θ3 are set to satisfy the following Formula F1.

$$\theta 2 \geq \theta 3 \quad \text{(F1)}$$

Meanwhile, in the cross-section parallel to the axial direction of the passage formation member 35, an angle obtained by doubling θ2 corresponds to a spread angle of the inlet side of the nozzle passage 13*a* in the passage formation member 35, and an angle obtained by doubling θ3 corresponds to a spread angle of the outlet side of the nozzle passage 13*a* in the passage formation member 35.

Therefore, with the satisfaction of the above Formula F1, the spread angle of the portion of the passage formation member 35 forming the outlet side of the nozzle passage 13*a* becomes smaller than the spread angle of the portion forming the inlet side of the nozzle passage 13*a*. Therefore, in this embodiment, a value of θ3 is set to a relatively small value (15° or smaller in this embodiment), and the nozzle passage 13*a* is defined so that the flowing direction of the mainstream of the ejection refrigerant flowing out of the nozzle passage 13*a* into the mixing passage 13*d* comes closer to the vertical direction.

As illustrated in FIG. 4, the suction passage 13*b* has an outlet on an outer side of the outlet of the nozzle passage 13*a* in the radial direction of the passage formation member 35. In the cross-section parallel to the axial direction of the passage formation member 35, the middle body 33 has a suction outlet portion C1 that defines an outer side of the outlet of the suction passage 13*b* (specifically, the suction passage 30*d*) in the radial direction. As a tangent Ls at the suction outlet portion C1, a tapered tip part (a portion defining an inside of the outlet of the suction passage 13*b* in the radial direction) 32*a* of the nozzle body 32 is sandwiched between the tangent Ld3 and the tangent Ls. When an acute angle between the tangent Ld3 and the tangent Ls is defined as θ1, θ1 is set to satisfy the following Formula F2.

$$\theta 1 \leq \theta 2/2 \quad \text{(F2)}$$

As is apparent from FIG. 4, the tangent Ld3 and the tangent Ls at the outer peripheral side of the outlet of the suction passage 13*b* are brought closer to parallel to each other as θ1 becomes smaller. Therefore, in this embodiment, a value of θ1 is set to a relatively small value (30° or smaller in this embodiment), and the suction passage 13*b* is defined so that the flowing direction of the mainstream of the suction refrigerant flowing out of the suction passage 13*b* into the mixing passage 13*d* is brought closer to the vertical direction.

The mixing passage 13*d* is formed into a shape gradually reduced in the passage cross-sectional area toward the downstream side in the refrigerant flow. In this case, the passage cross-sectional area of the mixing passage 13*d* can be defined as an area of an outer peripheral side surface formed into a truncated conical shape formed when rotating around the axis a line segment extending from the outer peripheral surface of the passage formation member 35 in the normal direction, and reaching the inner peripheral surface of the mixing space 30*h* in the middle body 33.

The "toward the downstream side in the refrigerant flow" can be defined by the meaning of "toward the downstream side from the upper side along the outer peripheral surface of the passage formation member 35 in the cross-section of the passage formation member 35 parallel to the axial direction".

A cross-sectional shape perpendicular to an axial direction of the mixing passage 13*d* is also formed in an annular shape, and a refrigerant flowing through the mixing passage 13*d* also has a velocity component of the refrigerant swirling in the same direction as the swirl direction of the refrigerant swirling in the swirling space 30*a* due to the velocity component in the swirl direction of the ejection refrigerant ejected from the nozzle passage 13*a* and the velocity component in the swirl direction of the suction refrigerant drawn from the suction passage 13*b*.

As illustrated in FIG. 2, a pressurizing space 30*e* formed into a substantially truncated conical shape gradually spread in the refrigerant flowing direction is formed in the through hole of the middle body 33 on the downstream side of the mixing passage space in the refrigerant flow. The pressurizing space 30*e* is a space into which the refrigerant that has flowed out of the mixing space 30*h* (specifically, the mixing passage 13*d*) flows.

A lower portion of the above-mentioned passage formation member 35 is disposed in the pressurizing space 30*e*. Further, a spread angle of the conical-shaped side surface of the passage formation member 35 in the pressurizing space 30*e* is smaller than a spread angle of the circular truncated conical space of the pressurizing space 30*e*. Therefore, the refrigerant passage cross-sectional area of the refrigerant passage is gradually increased toward the downstream side in the refrigerant flow.

In this embodiment, with an increase in the refrigerant passage cross-sectional area as described above, as illustrated in FIG. 3, a diffuser passage 13*c* that functions as the diffuser is disposed between the inner peripheral surface of the middle body 33 and the outer peripheral surface of the lower side of the passage formation member 35, which configures the pressurizing space 30*e*. The diffuser passage 13*c* allows a kinetic energy of a mixed refrigerant mixed in the mixing passage 13*d* to be converted into a pressure energy.

A cross-sectional shape of the diffuser passage 13*c* perpendicular to an axial direction of the diffuser passage 13*c* is also formed into an annular shape, and a refrigerant flowing through the diffuser passage 13*c* also has a velocity component of the refrigerant swirling in the same direction as the swirl direction of the refrigerant swirling in the swirling space 30*a* due to the velocity component in the swirl direction of the ejection refrigerant ejected from the nozzle passage 13*a* and the velocity component in the swirl direction of the suction refrigerant drawn from the suction passage 13*b*.

Next, the driving device 37 that is disposed in the interior of the middle body 33 and displaces the passage formation member 35 will be described. The driving device 37 includes a circular laminated diaphragm 37*a* which is a pressure responsive member. More specifically, as illustrated in FIG. 2, the diaphragm 37*a* is fixed by a technique such as welding so as to partition a cylindrical space defined on the outer peripheral side of the middle body 33 into two upper and lower spaces.

The upper space (the inflow space 30*c* side) of the two spaces partitioned by the diaphragm 37*a* configures a sealed space 37*b* in which a temperature sensitive medium is enclosed. A pressure of the temperature sensitive medium changes according to a temperature of the refrigerant that has flowed out of the evaporator 14. A temperature sensitive medium having the same composition as that of the refrigerant circulating through the ejector refrigeration cycle 10 is sealed in the sealed space 37*b* at predetermined density. Accordingly, the temperature sensitive medium of this embodiment is R134a.

On the other hand, the lower space of the two spaces partitioned by the diaphragm 37*a* configures an introduction space 37*c* into which the refrigerant that has flowed out of the evaporator 14 is introduced through a communication channel not shown. Therefore, the temperature of the refrigerant that has flowed out of the evaporator 14 is transmitted to the temperature sensitive medium enclosed in the sealed space 37*b* through a cap member 37*d* and the diaphragm 37*a*. The cap member 37*d* separates the inflow space 30*c* and the sealed space 37*b* from each other.

As is apparent from FIGS. 2 and 3, the suction passage 13*b* is disposed on the upper side of the middle body 33 of this embodiment, and the diffuser passage 13*c* is disposed on the lower side of the middle body 33. Therefore, at least a part of the driving device 37 is disposed at a position sandwiched between the suction passage 13*b* and the diffuser passage 13*c* from the vertical direction when viewed from the radial direction of the axis line.

In more detail, the sealed space 37*b* of the driving device 37 is disposed at a position to overlap with the suction passage 13*b* and the diffuser passage 13*c* and at a position surrounded by the suction passage 13*b* and the diffuser passage 13*c* when viewed from a center axis K direction of the swirling space 30*a* and the passage formation member 35. With this configuration, the temperature of the refrigerant that has flowed out of the evaporator 14 is transmitted to the sealed space 37*b*, and an internal pressure within the sealed space 37*b* becomes a pressure corresponding to the temperature of the refrigerant that has flowed out of the evaporator 14.

Further, the diaphragm 37*a* is deformed according to a differential pressure between the internal pressure of the sealed space 37*b* and the pressure of the refrigerant which has flowed into the introduction space 37*c* out of the evaporator 14. For that reason, it is preferable that the diaphragm 37*a* is made of a material rich in elasticity, excellent in heat conduction, and tough. For example, it is desirable that the diaphragm 37*a* is formed of a metal laminate made of stainless steel (SUS304).

An upper end side of a cylindrical actuating bar 37*e* is joined to a center part of the diaphragm 37*a* by a technique such as welding, and a lower end side of the actuating bar 37*e* is fixed to an outer peripheral and lowermost side (bottom) of the passage formation member 35. With this configuration, the diaphragm 37*a* and the passage formation member 35 are coupled with each other, and the passage formation member 35 is displaced in accordance with a displacement of the diaphragm 37*a* to adjust the refrigerant passage cross-sectional area of the nozzle passage 13*a* (passage cross-sectional area in the minimum passage area part 30*m*).

Specifically, when the temperature (the degree of superheat) of the refrigerant following out of the evaporator 14 rises, a saturated pressure of the temperature sensitive medium enclosed in the sealed space 37*b* rises to increase a differential pressure obtained by subtracting the pressure of the introduction space 37*c* from the internal pressure of the sealed space 37*b*. Accordingly, the diaphragm 37*a* displaces the passage formation member 35 in a direction of increasing the passage cross-sectional area in the minimum passage area part 30*m* (downward in the vertical direction).

On the other hand, when the temperature (the degree of superheat) of the refrigerant flowing out of the evaporator 14 falls, the saturated pressure of the temperature sensitive medium enclosed in the sealed space 37*b* falls to decrease the differential pressure obtained by subtracting the pressure of the introduction space 37*c* from the internal pressure of the sealed space 37*b*. With the above configuration, the diaphragm 37*a* displaces the passage formation member 35 in a direction of reducing the passage cross-sectional area of the minimum passage area part 30*m* (toward the upper side in the vertical direction).

The diaphragm 37*a* displaces the passage formation member 35 vertically according to the degree of superheat of the refrigerant that has flowed out of the evaporator 14 as described above. As a result, the passage cross-sectional area of the minimum passage area part 30*m* can be adjusted so that the degree of superheat of the refrigerant that has flowed out of the evaporator 14 comes closer to a predetermined value. A gap between the actuating bar 37*e* and the middle body 33 is sealed by a seal member such as an O-ring not shown, and the refrigerant is not leaked through the gap even if the actuating bar 37*e* is displaced.

The bottom of the passage formation member 35 is subjected to a load of a coil spring 40 fixed to the lower body 34. The coil spring 40 urges the load against the passage formation member 35 so as to reduce the passage cross-sectional area in the minimum passage area part 30*m* (upper side in FIG. 2). With the adjustment of this load, a valve opening pressure of the passage formation member 35 can be changed to change a target degree of superheat.

Further, in this embodiment, the multiple (specifically, two) cylindrical spaces are defined on the outer peripheral side of the part of the middle body 33, and the respective circular laminated diaphragms 37*a* are fixed in those spaces to configure two driving devices 37. However, the number of driving devices 37 is not limited to this number. When the driving devices 37 are provided at multiple locations, it is desirable that the respective driving devices 37 are arranged at regular angular intervals with respect to the center axis K.

Alternatively, a diaphragm formed of the annular thin plate may be fixed in a space having an annular shape when viewed from the axial direction, and the diaphragm and the passage formation member 35 may be coupled with each other by multiple actuating bars.

Next, the lower body 34 is formed of a circular-cylindrical metal member, and fixed in the housing body 31 by a technique such as screwing so as to close a bottom of the housing body 31. In the internal space of the housing body 31, the gas-liquid separation space 30*f* that separates gas and liquid of the refrigerant that has flowed out of the diffuser passage 13*c* from each other is provided between the upper surface side of the lower body 34 and the bottom surface side of the middle body 33.

The gas-liquid separation space 30*f* is defined as a space of a substantially cylindrical rotating body shape, and the gas-liquid separation space 30*f* is also disposed coaxially with the center axis K of the swirling space 30*a*, the depressurizing space 30*b*, and the passage formation member 35.

As described above, the refrigerant, which flows out of the diffuser passage 13*c* into the gas-liquid separation space 30*f*, has the velocity component of the refrigerant swirling in the same direction as the swirl direction of the refrigerant swirling in the swirling space 30*a*. Accordingly, gas and liquid of the refrigerant are separated in the gas-liquid separation space 30*f* by action of a centrifugal force.

A cylindrical pipe 34*a* that is disposed coaxially with the gas-liquid separation space 30*f* and extends upward is disposed in the center part of the lower body 34. The liquid-phase refrigerant separated in the gas-liquid separation space 30*f* is accumulated on an outer peripheral side of the pipe 34*a*. A gas-phase refrigerant outflow passage 34*b* is provided inside the pipe 34*a* and guides the gas-phase refrigerant separated in the gas-liquid separation space 30*f* to the gas-phase refrigerant outlet port 31*d*.

Further, the above-mentioned coil spring 40 is fixed to an upper end of the pipe 34*a*. The coil spring 40 also functions as a vibration absorbing member that attenuates the vibration of the passage formation member 35, which is caused by a pressure pulsation generated when the refrigerant is depressurized. An oil return hole 34*c* is defined on a base part (lowermost part) of the pipe 34*a*. The oil return hole 34*c* returns a refrigerator oil in the liquid-phase refrigerant into the compressor 11 through the gas-phase refrigerant outflow passage 34*b*.

The liquid-phase refrigerant outlet port 31*c* of the ejector 13 is connected with an inlet side of the evaporator 14 as illustrated in FIG. 1. The evaporator 14 is a heat-absorbing heat exchanger that exchanges heat between the low-pressure refrigerant depressurized by the ejector 13 and blast air that is blown into the vehicle interior from a blower fan 14*a*. As a result, the evaporator 14 evaporates the low-pressure refrigerant and exerts a heat absorbing action.

The blower fan 14*a* is an electric blower of which the rotation speed (the amount of blast air) is controlled by a control voltage output from the control device. The refrigerant suction port 31*b* of the ejector 13 is connected to an outlet side of the evaporator 14. Further, the gas-phase refrigerant outlet port 31*d* of the ejector 13 is connected with the intake side of the compressor 11.

Next, the control device not shown includes a well-known microcomputer including a CPU, a ROM and a RAM, and peripheral circuits of the microcomputer. The control device controls the operations of the above-mentioned various electric actuators 11*b*, 12*d*, and 14*a* by performing various calculations and processing on the basis of a control program stored in the ROM.

Further, the control device is connected with air conditioning control sensors such as an inside air temperature sensor for detecting a vehicle interior temperature, an outside air temperature sensor for detecting the temperature of an outside air, an insulation sensor for detecting the amount of insulation in the vehicle interior, an evaporator temperature sensor for detecting the blow-out air temperature from the evaporator 14 (the temperature of the evaporator), an outlet side temperature sensor for detecting a temperature of the refrigerant on the outlet side of the heat radiator 12, and an outlet side pressure sensor for detecting a pressure of the refrigerant on the outlet side of the heat radiator 12. Accordingly, detection values of those sensors are input to the control device.

Furthermore, an operation panel not shown, which is disposed in the vicinity of a dashboard panel positioned at a front part in the vehicle interior, is connected to the input side of the control device, and operation signals output from various operation switches mounted on the operation panel are input to the control device. An air conditioning operation switch that is used to perform air conditioning in the vehicle interior, a vehicle interior temperature setting switch that is used to set the temperature of the vehicle interior, and the like are provided as the various operation switches that are mounted on the operation panel.

Meanwhile, the control device of this embodiment is integrated with a control unit for controlling the operations of various control target devices connected to the output side of the control device, but a configuration of the control device (hardware and software), which controls the operations of the respective control target devices forms the control unit of the respective control target devices. For example, in this embodiment, a configuration (hardware and software), which controls the operation of the electric motor 11*b* of the compressor 11, forms a discharge capability control unit.

Next, the operation of this embodiment configured as described above will be described with reference to a Mollier diagram of FIG. 5. The axis of ordinate in the Mollier diagram represents pressures corresponding to P0, P1, and P2 in FIG. 3. First, when the operation switch of the operation panel is turned on, the control device actuates the electric motor 11*b* of the compressor 11, the cooling fan 12*d*, the blower fan 14*a*, and so on. Accordingly, the compressor 11 draws, compresses, and discharges the refrigerant.

The gas-phase refrigerant (point a5 in FIG. 5) of a high temperature and high pressure state, which is discharged from the compressor 11, flows into the condenser 12*a* of the heat radiator 12, performs heat exchange with the blast air (outside air), which is blown from the cooling fan 12*d*, radiates a heat, and is condensed. The refrigerant radiated by the condenser 12*a* is separated into gas and liquid by the receiver portion 12*b*. A liquid-phase refrigerant, which has been subjected to gas-liquid separation in the receiver part 12*b*, is changed into a subcooled liquid-phase refrigerant by exchanging heat with the blast air, which is blown from the cooling fan 12*d* in the subcooling portion 12*c* and further radiating heat (from point a5 to point b5 in FIG. 5).

Figure 5:
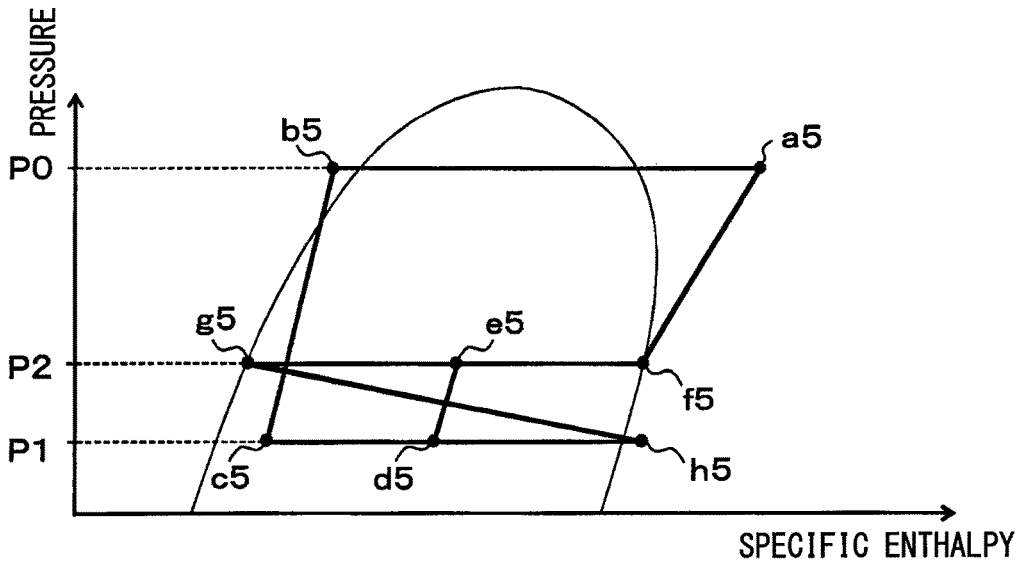
FIG. 5 is a Mollier diagram illustrating a state of a refrigerant in the ejector refrigeration cycle according to the embodiment.

The subcooled liquid-phase refrigerant that has flowed out of the subcooling portion 12*c* of the heat radiator 12 is isentropically depressurized by the nozzle passage 13*a*, and ejected (from point b5 to point c5 in FIG. 5). The nozzle passage 13*a* is defined between the inner peripheral surface of the depressurizing space 30*b* of the ejector 13 and the outer peripheral surface of the passage formation member 35. In this situation, the refrigerant passage cross-sectional area of the depressurizing space 30*b* in the minimum passage area part 30*m* is adjusted so that the degree of superheat of the refrigerant on the outlet side of the evaporator 14 comes closer to a predetermined given value.

The refrigerant that has flowed out of the evaporator 14 is drawn through the refrigerant suction port 31*b* and the suction passage 13*b* (in more detail, the inflow space 30*c* and the suction passage 30*d*) due to the suction action of the ejection refrigerant which has been ejected from the nozzle passage 13*a*. In addition, the ejection refrigerant ejected from the nozzle passage 13*a* and the suction refrigerant drawn through the suction passage 13*b* and the like flow into the mixing passage 13*d*, and are mixed together (from point c5 to point d5, and from point h5 to point d5 in FIG. 5).

The mixed refrigerants mixed by the mixing passage 13*d* flow into the diffuser passage 13*c*. In the diffuser passage 13*c*, a kinetic energy of the refrigerant is converted into a pressure energy by an increase in the refrigerant passage cross-sectional area. As a result, a pressure of the mixed refrigerant is increased while the ejection refrigerant and the suction refrigerant are mixed together (from point d5 to point e5 in FIG. 5). The refrigerant that has flowed out of the diffuser passage 13*c* is separated into gas and liquid in the gas-liquid separation space 30*f* (from point e5 to point f5, and from point e5 to point g5 in FIG. 5).

The liquid-phase refrigerant that has been separated in the gas-liquid separation space 30*f* flows out of the liquid-phase refrigerant outlet port 31*c*, and flows into the evaporator 14. The refrigerant which has flowed into the evaporator 14 absorbs heat from the blast air blown by the blower fan 14*a*, evaporates, and cools the blast air (point g5 to point h5 in FIG. 5). On the other hand, the gas-phase refrigerant that has been separated in the gas-liquid separation space 30*f* flows out of the gas-phase refrigerant outlet port 31*d*, and is drawn into the compressor 11 and compressed again (point f5 to point a5 in FIG. 5).

The ejector refrigeration cycle 10 of this embodiment operates as described above, and can cool the blast air to be blown into the vehicle interior. Further, in the ejector refrigeration cycle 10, since the refrigerant pressurized by the diffuser passage 13*c* is drawn into the compressor 11, the drive power of the compressor 11 can be reduced to improve the cycle efficiency (COP).

Further, according to the ejector 13 of this embodiment, the refrigerant is swirled in the swirling space 30*a* with the results that a refrigerant pressure on a swirling center side in the swirling space 30*a* can be reduced to a pressure of a saturated liquid-phase refrigerant, or a pressure at which the refrigerant is depressurized and boiled (cavitation occurs). With the above operation, a larger amount of gas-phase refrigerant is present on an inner peripheral side than an outer peripheral side of a swirling center axis K. This can lead to a two-phase separation state in which the refrigerant has a gas single phase in the vicinity of a swirling center line within the swirling space 30*a*, and has a liquid single phase around the vicinity thereof.

The refrigerant that has become in the two-phase separation state as described above flows into the nozzle passage 13*a*. As a result, in the convergent part 131 of the nozzle passage 13*a*, boiling of the refrigerant is promoted by a wall surface boiling generated when the refrigerant is separated from the outer peripheral side wall surface of the annular refrigerant passage, and an interface boiling caused by a boiling nuclear generated by the cavitation of the refrigerant on the center axis K side of the annular refrigerant passage. Accordingly, the refrigerant that flows into the minimum passage area part 30*m* of the nozzle passage 13*a* is brought closer to a gas-liquid mixed state in which the gas phase and the liquid phase are homogeneously mixed together.

The flow of the refrigerant in the gas-liquid mixed state is blocked (choked) in the vicinity of the minimum passage area part 30*m*. The refrigerant in the gas-liquid mixed state which reaches the sonic speed by the choking is accelerated in the divergent part 132, and ejected. As described above, the refrigerant of the gas-liquid mixed state can be efficiently accelerated to the sonic speed by the boiling promotion caused by both of the wall surface boiling and the interface boiling. As a result, the energy conversion efficiency (corresponding to the nozzle efficiency) in the nozzle passage 13*a* can be improved.

In addition, the ejector 13 of this embodiment employs the passage formation member 35 having a conical shape of which a cross-sectional area increases with distance from the depressurizing space 30*b*. The cross-sectional shape of the diffuser passage 13*c* is formed in an annular shape. Therefore, the diffuser passage 13*c* can have a shape to spread along the outer periphery of the passage formation member 35 with distance from the depressurizing space 30*b*.

Therefore, the dimension of the diffuser passage 13*c* in the axial direction (axial direction of the passage formation member 35) can be restrained from being increased. As a result, an increase in the volume of the overall ejector 13 can be suppressed.

According to the ejector 13 of this embodiment, since the driving device 37 is provided, the passage formation member 35 can be displaced in accordance with a load variation of the ejector refrigeration cycle 10 to adjust the refrigerant passage cross-sectional areas of the nozzle passage 13*a* and the diffuser passage 13*c*. Accordingly, the ejector 13 can be appropriately operated according to a load variation of the ejector refrigeration cycle 10.

In the configuration where the nozzle passage 13*a* is disposed on the outer peripheral side of the passage formation member 35 as in the ejector 13 of this embodiment, the ejection refrigerant ejected from the nozzle passage 13*a* flows along the outer peripheral side of the passage formation member 35.

Further, in the configuration for adjusting the refrigerant passage cross-sectional area (passage cross-sectional area in the minimum passage area part 30*m*) of the nozzle passage 13*a* with the displacement of the passage formation member 35, in order to appropriately adjust the refrigerant passage cross-sectional area of the nozzle passage 13*a*, there is a need to set the spread angle in the cross-section parallel to the axial direction of the passage formation member 35 to be relatively larger (for example, 60° or larger).

For that reason, when the passage formation member 35 is formed into a conical shape whose cross-sectional shape parallel to the axial direction is a simple isosceles triangle, the intersection angle between the flowing direction of the mainstream of the ejection refrigerant flowing out of the nozzle passage 13*a* into the mixing passage 13*d* and the flowing direction of the mainstream of the suction refrigerant flowing out of the suction passage 13*b* into the mixing passage 13*d* is likely to increase.

When the flowing direction of the mainstream of the ejection refrigerant intersects with the flowing direction of the mainstream of the suction refrigerant at the relatively large angle, an energy loss (mixing loss) when the ejection refrigerant joins the suction refrigerant increases, and the kinetic energy of the mixed refrigerant to be converted into the pressure energy is reduced in the diffuser passage. This causes a reduction in the ejector efficiency.

On the contrary, according to the ejector 13 of this embodiment, since the angles θ2 and θ3 are set to satisfy the above-mentioned Formula F1, the spread angle (corresponding to θ3×2 in FIG. 4) of the portion forming the outlet side of the nozzle passage 13*a* in the passage formation member 35 can be set to be smaller than the spread angle (corresponding to θ2×2 in FIG. 4) of the portion forming the inlet side of the nozzle passage 13*a* in the passage formation member 35 in the cross-section parallel to the axial direction of the passage formation member 35.

In other words, the spread angle of the portion forming the outlet side of the nozzle passage 13*a* in the passage formation member 35 can be set to be smaller regardless of the spread angle of the portion forming the inlet side of the nozzle passage 13*a* in the passage formation member 35, and the flowing direction of the mainstream of the ejection refrigerant ejected from the nozzle passage 13*a* can be brought closer to the axial direction of the passage formation member 35.

Further, the flowing direction of the mainstream of the suction refrigerant flowing out of the suction passage 13*b* and joining the ejection refrigerant is brought closer to the axial direction with the result that an intersecting angle between the flowing direction of the mainstream of the ejection refrigerant and the flowing direction of the mainstream of the suction refrigerant can be reduced. Therefore, an energy loss (mixing loss) when the ejection refrigerant joins the suction refrigerant can be suppressed, and a reduction in the ejector efficiency can be suppressed.

In this situation, as illustrated in FIGS. 2 to 4, the tapered tip part 32*a* of the nozzle body 32 functioning as the guide part for bringing the flowing direction of the mainstream of the suction refrigerant closer to the axial direction can be formed into a shape extending in the axial direction, and does not need to be formed in a shape spread in the radial direction. Therefore, the volume of the passage formation member 35 in the radial direction can be restrained from being increased as the overall ejector 13.

Further, even if the spread angle of the portion forming the outlet side of the nozzle passage 13*a* in the passage formation member 35 is set to the relatively small value in the cross-section parallel to the axial direction of the passage formation member 35, the spread angle of the portion forming the inlet side of the nozzle passage 13*a* in the passage formation member 35 can be set to an appropriate value. Therefore, the degree of change in the refrigerant passage cross-sectional area on the inlet side of the nozzle passage 13*a* relative to the amount of displacement (the amount of stroke) of the passage formation member 35 can be restrained from being reduced.

With the above configuration, there is no need to increase the maximum amount of displacement of the passage formation member 35 for the purpose of properly adjusting the refrigerant passage cross-sectional area on the inlet side of the nozzle passage 13*a*. Therefore, the volume of the passage formation member 35 in the axial direction can be restrained from being increased as the overall ejector 13.

In other words, according to the ejector 13 of this embodiment, even in the ejector 13 in which the refrigerant passage is defined on the outer peripheral side of the passage formation member 35, the flowing direction of the mainstream of the ejection refrigerant can be brought closer to the flowing direction of the mainstream of the suction refrigerant without increasing the volume. Therefore, a reduction in the ejector efficiency can be suppressed with the suppression of the energy loss when the ejection refrigerant joins the suction refrigerant.

According to the ejector 13 of this embodiment, since $\theta 1$ is set to satisfy the above-mentioned Formula F2, the reduction in the ejector efficiency can be effectively suppressed. According to the present inventors' study, when $\theta 1$ is larger than $\theta 2/2$, it is confirmed that the ejector efficiency is reduced by 24% or higher as compared with a case in which $\theta 1$ is 0° (in other words, a case in which the flowing direction of the mainstream of the ejection refrigerant is substantially in parallel to the flowing direction of the mainstream of the suction refrigerant).

According to the ejector 13 of this embodiment, since the mixing passage 13*d* is formed into a shape gradually reduced in the passage cross-sectional area toward a downstream side in the refrigerant flow, the mixed refrigerants of the ejection refrigerant and the suction refrigerant flowing into the mixing passage 13*d* can be accelerated. With the above configuration, the pressure of the mixed refrigerants can be gradually reduced toward an outlet side in the mixing passage 13*d*.

Further, since the ejection refrigerant and the suction refrigerant flowing into the mixing passage 13*d* flow toward the outlet side low in pressure, the flow of the ejection refrigerant can be restrained from drifting to the outer peripheral surface side of the passage formation member 35 or the inner peripheral surface side of the portion forming the mixing space 30*h* in the middle body 33.

Therefore, droplets (grains of the liquid-phase refrigerant) in the ejection refrigerant can be restrained from adhering to the outer peripheral surface of the passage formation member 35 or the inner peripheral surface of the portion forming the mixing space 30*h* in the middle body 33, and the droplets in the ejection refrigerant, the gas-phase refrigerant in the ejection refrigerant, and the suction refrigerant (gas-phase refrigerant) can be sufficiently mixed together in the mixing passage 13*d*. The velocity energy of the droplets in the ejection refrigerant can be effectively transmitted to the gas-phase refrigerant in the mixed refrigerants.

As a result, the kinetic energy of the mixed refrigerants, which is converted into a pressure energy in the diffuser passage 13*c*, can be restrained from being reduced, and a reduction in the pressure increase amount in the diffuser passage 13*c* can be suppressed. Therefore, a reduction in the ejector efficiency can be suppressed.

According to the present inventors' study, it is found that even if the mixing passage 13*d* is formed into a shape constant in the passage cross-sectional area toward a downstream side in the refrigerant flow, a pressure on the outlet side of the mixing passage 13*d* can be sufficiently reduced, and the droplets in the ejection refrigerant, the gas-phase refrigerant in the ejection refrigerant, and the suction refrigerant (gas-phase refrigerant) can be sufficiently mixed together in the mixing passage 13*d*.

The gas-liquid separation space 30*f* that separates gas and liquid of the refrigerant that has flowed out of the diffuser passage 13*c* from each other is formed in the body 30 of the ejector 13 of this embodiment. Hence, the capacity of the gas-liquid separation space 30*f* can be effectively reduced as compared with a case in which a gas-liquid separation device is provided separately from the ejector 13.

In other words, in the gas-liquid separation space 30*f* of this embodiment, since the refrigerant that flows out of the diffuser passage 13*c* formed in an annular section has velocity components in the swirl direction in advance, there is no need to provide a space for generating the swirl flow of the refrigerant in the gas-liquid separation space 30*f*. Therefore, the capacity of the gas-liquid separation space 30*f* can be effectively reduced as compared with the case in which the gas-liquid separation device is provided apart from the ejector 13.

The present disclosure is not limited to the above-described embodiments, but various modifications can be made thereto as follows without departing from the spirit of the present disclosure.

(1) In the above embodiments, the description has been given of the example in which the driving device 37 that displaces the passage formation member 35 includes the sealed space 37*b* in which the temperature sensitive medium having the pressure changed according to a change in the temperature is enclosed, and the diaphragm 37*a* that is displaced according to the pressure of the temperature sensitive medium within the sealed space 37*b*. However, the driving device is not limited to this configuration.

For example, a thermowax having a volume changed according to the temperature may be employed as the temperature sensitive medium, or a configuration having an elastic member of a shape memory alloy may be used as the driving device. Further, a configuration in which the passage formation member 35 may be displaced by an electric mechanism such as an electric motor or a solenoid may be employed as the driving device.

(2) In the above embodiments, the details of the liquid-phase refrigerant outlet port 31*c* of the ejector 13 are not described. A depressurizing device (for example, side fixed aperture including an orifice or a capillary tube) for depressurizing the refrigerant may be disposed on the liquid-phase refrigerant outlet port 31*c*.

(3) In the above embodiments, the example in which the ejector refrigeration cycle 10 including the ejector 13 of the present disclosure is applied to the vehicle air conditioning apparatus has been described, but the application of the ejector refrigeration cycle 10 having the ejector 13 of the present disclosure is not limited to this configuration. For example, the ejector refrigeration cycle 10 may be applied to, for example, a stationary air conditioning apparatus, a cold storage warehouse, a vending machine-cooling heating device, and so on.

In the above-described embodiments, the heat radiator 12 is used as an outdoor side heat exchanger that exchanges heat between the refrigerant and the outside air, and the evaporator 14 is used as a utilization side heat exchanger that cools the blast air. Conversely, the ejector 13 of the present disclosure may be applied to a heat pump cycle in which the evaporator 14 is configured as the outdoor side heat exchanger that absorbs heat from a heat source such as the outside air, and the heat radiator 12 is configured as the indoor side heat exchanger that heats a fluid to be heated such as air or water.

(4) In the above-described embodiments, examples in which a subcooling heat exchanger is employed as the heat radiator 12 have been described, but, it is needless to say that a normal heat radiator formed of only the condenser 12*a* may be employed as the heat radiator 12. In the above-described embodiments, the example in which the components such as the body 30 of the ejectors 13 and the passage formation member 35 are made of metal has been described. However, as long as functions of the respective components can be exerted, the materials are not limited. Accordingly, those components may be made of a resin.

The invention claimed is:

1. An ejector for a vapor compression refrigeration cycle device, comprising:

a body including a refrigerant inlet port through which a refrigerant is introduced from the vapor compression refrigeration cycle device, a swirling space in which the refrigerant flowing from the refrigerant inlet port is swirled, a depressurizing space in which the refrigerant flowing out of the swirling space is depressurized, a suction passage that communicates with a downstream side of the depressurizing space in a refrigerant flow and draws a refrigerant from an external, and a pressurizing space into which an ejection refrigerant ejected from the depressurizing space and a suction refrigerant drawn through the suction passage flow; and a passage formation member that is disposed at least in an interior of the depressurizing space and in an interior of the pressurizing space and has a conical shape increasing in cross-sectional area with distance from the depressurizing space, wherein the depressurizing space has a nozzle passage, which functions as a nozzle that depressurizes and ejects the refrigerant that has flowed out of the swirling space, between an inner peripheral surface of the body and an outer peripheral surface of the passage formation member, the pressurizing space has a diffuser passage, which functions as a diffuser that converts a kinetic energy of a mixed refrigerant of the ejection refrigerant and the suction refrigerant into a pressure energy, between the inner peripheral surface of the body and the outer peripheral surface of the passage formation member, in a cross-section parallel to an axial direction of the passage formation member, the outer peripheral surface of the passage formation member that defines the nozzle passage has a curved surface, and a distance from a center axis of the passage formation member to the curved surface of the passage formation member gradually increases toward the downstream side in the refrigerant flow, in the cross-section parallel to the axial direction, the inner peripheral surface of the body that defines the nozzle passage has a curved surface, and a distance from the center axis of the passage formation member to the curved surface of the body gradually increases toward the downstream side in the refrigerant flow, the curved surface of the passage formation member has a contact portion that contacts the body in the nozzle passage when the passage formation member is displaced in the axial direction, in the cross-section parallel to the axial direction of the passage formation member, in the cross-section parallel to the axial direction, an acute angle between a tangent at the contact portion and the center axis is defined as $\theta 2$, the curved surface of the passage formation member has a nozzle outlet portion that defines an outlet of the nozzle passage in the cross-section parallel to the axial direction, in the cross-section parallel to the axial direction, an acute angle between a tangent at the nozzle outlet portion and the center axis is defined as $\theta 3$, a rate of the increase of the distance from the center axis to the curved surface of the passage formation member gradually reduces toward the downstream side from the contact portion to the nozzle outlet portion in the refrigerant flow such that the angle $\theta 2$ and the angle $\theta 3$ satisfy a condition: $\theta 2 \geq \theta 3$, and a rate of the increase of the distance from the center axis to the curved surface of the body gradually reduces toward the downstream side from the contact portion to the nozzle outlet portion in the refrigerant flow.

2. The ejector according to claim 1, wherein the suction passage has an outlet on an outer side of the outlet of the nozzle passage in a radial direction of the passage formation member, the body has a suction outlet portion that defines an outer side of the outlet of the suction passage in the radial direction, in the cross-section parallel to the axial direction, in the cross-section parallel to the axial direction, an acute angle between a tangent at the nozzle outlet portion and a tangent at the suction outlet portion is defined as $\theta 1$, and the angle $\theta 1$ and the angle $\theta 2$ satisfy a condition: $\theta 1 \leq \theta 2/2$.

3. The ejector according to claim 1, further comprising a driving device that displaces the passage formation member in the axial direction to change a cross-sectional area of the nozzle passage.

4. The ejector according to claim 1, wherein the body further includes a mixing space in which the ejection refrigerant joins the suction refrigerant, and the mixing space has a mixing passage, through which the ejection refrigerant and the suction refrigerant are mixed together and flow into the diffuser passage, between the inner peripheral surface of the body and the outer peripheral surface of the passage formation member.

5. The ejector according to claim 1, wherein the nozzle outlet portion is disposed in a region corresponding to a displaceable area of the passage formation member on the outer peripheral surface of the passage formation member.

6. The ejector according to claim 1, wherein an apex of the passage formation member is positioned in the depressurizing space when the passage formation member is displaced in the axial direction and contacts the body, and the apex of the passage formation member is moved from the depressurizing space toward the nozzle passage when the passage formation member is displaced in the axial direction away from the body.

7. The ejector according to claim 1, wherein an apex of the conical passage formation member enters the depressurizing space and moves into the nozzle passage so as to increase flow therethrough.

* * * * *